United States Patent [19]

Wada et al.

[11] 4,038,026

[45] July 26, 1977

[54] ELECTROPHOTOGRAPHIC FUSING APPARATUS

[75] Inventors: Kenichi Wada, Sakai; Yuji Enoguchi, Higashiosaka; Masaya Ogawa, Sakai; Hidetoshi Kawabata, Tondabayashi; Takaji Kurita, Kawachinagano; Susumu Tanaka, Sakai; Takao Fujiwara, Sakai; Hiroshi Murasaki, Sakai, all of Japan

[73] Assignee: Minolta Camera Kabushiki Kaisha, Osaka, Japan

[21] Appl. No.: 689,845

[22] Filed: May 25, 1976

Related U.S. Application Data

[62] Division of Ser. No. 585,709, June 10, 1975, Pat. No. 3,998,584.

[30] Foreign Application Priority Data

June 17, 1974 Japan ..... 49-69522
June 15, 1974 Japan ..... 49-68285

[51] Int. Cl.[2] ..... H05B 3/10; G03G 5/00

[52] U.S. Cl. ..... 432/60; 432/228; 219/469

[58] Field of Search ..... 432/59, 60, 227, 228, 432/45; 219/216, 388, 469; 355/3 FU; 226/176, 177, 186, 187; 271/273, 274; 100/93 RP

[56] References Cited

U.S. PATENT DOCUMENTS

| | | | |
|---|---|---|---|
| 3,219,794 | 11/1965 | Mindell et al. | 219/216 |
| 3,291,466 | 12/1966 | Aser et al. | 219/216 |
| 3,452,181 | 6/1969 | Stryjewski | 432/60 |
| 3,754,819 | 8/1973 | Braun | 355/3 FU |

OTHER PUBLICATIONS

IBM Technical Disclosure Bulletin, vol. 15, No. 5, Oct. 1972, p. 1454.

*Primary Examiner*—John J. Camby
*Assistant Examiner*—Henry C. Yuen
*Attorney, Agent, or Firm*—Watson, Cole, Grindle & Watson

[57] ABSTRACT

The heat and pressure rolls of a fusing apparatus for an electrophotographic copying machine are shifted into pressure contact with one another while a support sheet bearing a toner powder image passes therebetween, and are separated while the sheet is not therebetween. A driving mechanism drives both rolls when not in contact, while one of the rolls drives the other while in pressure contact. A shifting mechanism is actuated by a sheet detector for shifting the rolls into and out of contact.

In another embodiment, the rolls are in light rolling contact, with no sheet passing therebetween, under the weight of one of the rolls idly mounted in place. A pressing mechanism presses the rolls into pressure contact, upon actuation by a sheet detector, while the sheet passes between the rolls.

4 Claims, 15 Drawing Figures

ELECTROPHOTOGRAPHIC FUSING APPARATUS

This is a division, of application Ser. No. 585,709 filed June 10, 1975, now U.S. Pat. No. 3,998,584.

BACKGROUND OF THE INVENTION

This invention relates generally to a fusing apparatus for an electrophotographic machine, and more particularly to such an apparatus wherein a toner powder image formed on a support sheet is fused thereon by direct applications of heat and pressure with the use of a heat roll.

As is well known in the art of automatic copying machines using an electrophotographic process, an electrostatic latent image corresponding to an original to be copied is formed on a photosensitive member by exposing the original following the uniform application of electrostatic charges on the photosensitive member. The thus formed latent image is developed with a finely divided developing material or toner to form a powder image which is then transferred onto a support sheet such as paper. The support sheet bearing the toner powder image is subsequentially passed through a fusing apparatus and is thereafter discharged out of the machine as a final copy. There are two generally known types of fusing processes used in carrying out the fusing of the toner powder image. The first is an oven-type in which heat is applied over a wide portion of the support sheet, and the second is a heat-roll type in which the support sheet is simultaneously pressed and heated by a heat roll as it passes therethrough. Compared to the first type of fusing approach, the heat roll type is more efficient in that the time required for fusing the toner image is substantially reduced since the toner image is heated as it is directly compressed, and furthermore the size of the copying machine itself can be minimized because of the reduced space required for the heat roll type fusing apparatus.

However, because of the narrow proper temperature range required for the heat roll type fusing apparatus, the toner powder image will not be properly fused or fixed on the support sheet if the required surface temperature is not maintained. Thus, adhesion of the toner on the heat roll surface results thereby causing transfer of the adhered toner to the following support sheets at the fusing station. This phenomenon is generally referred to in the printing art as low temperature transfer or "offset". On the other hand, if the surface temperature of the heat roll is higher than the proper temperature required, the toner becomes over-fused and adheres on the heat roll surface simultaneously with the fusion on the support sheet so that adhered toner will be transferred to the next support sheet. This phenomenon is likewise referred to as "offset" or high temperature transfer. Another drawback with the use of the heat roll type fusing apparatus is that the support sheet, to which the toner image is fixed, often becomes wrapped about the heat roll thereby causing jamming due to the cohesive nature of the toner. In order to avoid the above described offset phenomenon, the heat roll is coated with a non-cohesive material such as silicone, rubber, silicone oil or is provided with a coating of Teflon, a DuPont Corporation product composed of tetrafluoroethylene resin. Although such coating prevents toner offset to a certain extent, a completely satisfactory fusing of toner powder images cannot be expected.

For fusing the toner powder image, it is necessary to apply adequate pressure between the heat roll and a support roll in contact therewith while the support sheet bearing a toner powder image passes therebetween during the fusing mode of the copying machine. However, since both rolls are coated with a non-cohesive material over their surfaces, if the pressure applied between rolls is made while the fusing apparatus is at rest, that is, while both rolls are not rotating, the roll surfaces are apt to become dented or uneven so that a non-uniform pressure is likely to be applied to the support sheet. To avoid such a problem, the fusing apparatus in accordance with one embodiment of the present invention is so designed that the rolls are pressed together with a sufficient pressure while the support sheet passes therebetween, and the rollers are separated when such support sheet is not disposed therebetween. Thus, no heating of the support roll occurs while the rolls are separated. An effect similar to a decrease in the heat-discharging area of the apparatus is therefore obtained with an accompanying improvement of the energy efficiency. In addition, the stand-by period for the fusing apparatus, that is the time required for the fusing apparatus to reach a proper fusing temperature, is reduced. Furthermore, the durability of both rolls is improved since there is no application of mechanical stresses thereon unless the support sheet is located therebetween, and since there is no continuous heat load under pressure on the support roll. Also, in the heat roll type fusing apparatus, heating of the toner powder image on the support sheet is effected by a single face application of heat from the heat roll only, and this is advantageous in that there will be no variance in the degree of fusion regardless of thickness or quality of paper used.

However, even if the heat and support rolls are separated at the time the support sheet is not located therebetween, both rolls must be continuously rotated while the machine is operating since, if the rolls are at rest, certain portions of both rolls will become over-heated to possibly exceed their heat resisting temperatures and thereby useless. This is particularly true in an arrangement wherein the heat roll is heated by an external heat source located immediately adjacent the roll. And, even if the heat roll is provided with a heat source located internally thereof, transfer of heat therefrom may cause a limited portion only of the support roll to be heated unless it is continuously rotated.

If both rolls are positively driven by means such as a gear arrangement, the difference in peripheral speeds on each roll will develop due to a difference in elasticity between both rolls. Such therefore causes the support sheet contacted by both rolls to possibly wrinkle, and to cause frictional wear of the roll surfaces. Furthermore, a quite complicated drive system will be required because of the need to intermittently separate the rolls. In addition, a sharp drop in surface temperature of the heat roll may take place during roll separation because of the transfer of heat to the cold support sheet at the moment of contact of both rolls. This may accordingly effect a low temperature transfer of toner powder image.

SUMMARY OF THE INVENTION

It is an object of the present invention to provide an improved heat roll type fusing apparatus capable of quickly fusing toner powder image in place without resulting in toner offset caused by high and low temperatures.

Another object of this invention is to provide such an apparatus which requires low energy for operation, is superior in temperature conditioning, is compact in size and is efficient in operation. A further object is to provide an improved drive system for the heat roll type fusing apparatus.

A still further object of the invention is to provide such an apparatus adapted to maintain the appropriate temperature range for fusing the toner powder images.

A still further object is to provide such an apparatus which avoids paper jamming.

One embodiment of the heat roll type fusing apparatus in accordance with the invention includes a pair of rolls between which a support sheet bearing a toner powder image passes, the rolls comprising heat and support rolls adapted to be pressed together as the support sheet passes therebetween at the fusing station, and to move apart from one another while the sheet is not located therebetween. The drive system permits one of the rolls to frictionally rotate together with the other roll when the rolls are in contact, and further permits the rolls to be driven independently while separated.

A heat roll type fusing apparatus in accordance with another embodiment of the invention includes a pressing mechanism for controlling the amount of pressure exerted between the heat roll and the support roll. With the use of such mechanism the rolls contact with the minimum contact pressure necessary for the heat roll to idly rotate when in contact with the support roll while the support sheet is not located therebetween, and the rolls contact with a sufficient pressure exerted for proper fusing of the toner powder image.

Other objects, advantages and novel features of the invention will become more apparent from the following detailed description of the invention when taken in conjunction with the accompanying drawings.

DESCRIPTION OF THE DETAILED EMBODIMENTS

Figure 1:
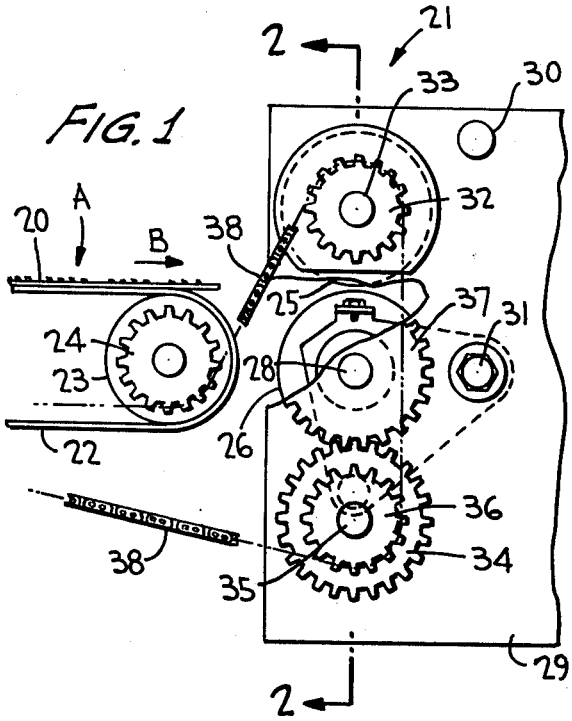
FIG. 1 is an elevational side view of the driving mechanism for the fusing apparatus in accordance with one embodiment of the invention.

Referring now to the drawings wherein like reference characters refer to like and corresponding parts throughout the several view a support sheet 20 is shown as having a toner image A formed on its surface, the sheet being transferred in the direction of arrow B in FIG. 1 to a fusing apparatus 21 by means of an endless belt 22 or the like. A portion of the belt is shown as extending about a conveyor wheel 23 having a chain sprocket wheel 24 fixedly mounted thereon. The showing of the other conveyor wheel is omitted for the sake of clarity.

A heat roll 25 is disposed above the travelling path of support sheet 20, such roll being rotated in direct contact with image A formed on the surface of sheet 20 so as to thereby heat the toner image. A support roll 26 is disposed below the travelling path of support sheet 20, such support roll rotating in contact with the undersurface of the sheet so as to support the sheet while passing through the fusing apparatus. The surface of heat roll 25 is coated with a non-adhesive material such as silicone rubber, silicone oil, or Teflon, which is a DuPont Corporation product composed of tetrafluoroethylene resin. The toner, which is fused under heat, will therefore not adhere to roll 25 while the surface of such roll is heated to a suitable temperature by means of a heat source 30 located outwardly of the heat roll. Alternatively, a heat source can be provided internally of the heat roll.

Figure 5:
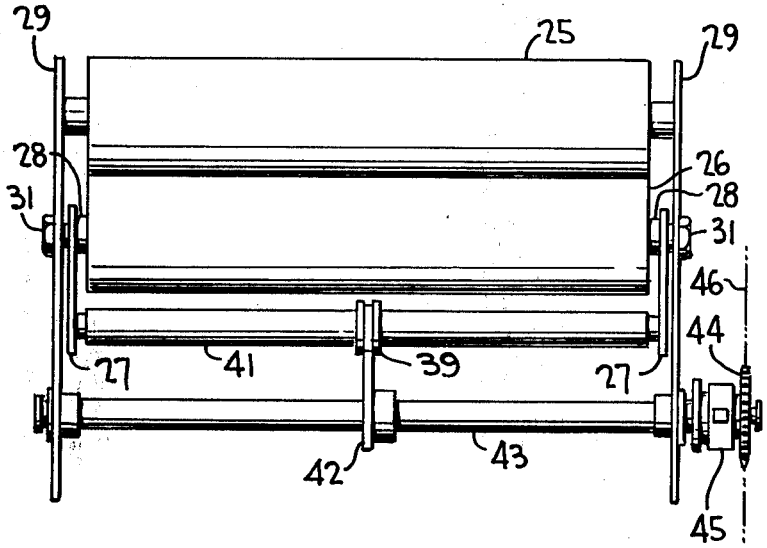
FIGS. 4 and 5 are respectively side elevational and front elevational views of the operating mechanism of the fusing apparatus in accordance with the one embodiment of the invention.

Support roll 26 is rotatably mounted at its opposite ends to levers 27 by means of its axial shaft 28 as shown in FIG. 5. The levers are pivotally mounted to spaced frame members 29 of a copying machine by means of support shafts 31. (Other portions of the copying machine are not shown for the sake of clarity). Thus, support roll 26 is moved in the direction of feed roll 25 so as to press support sheet 20 thereagainst as levers 27 are pivotally moved in that direction by means to be more fully hereinafter described. The toner image A is therefore pressed and heated while the sheet passes between the rolls at a predetermined rate of speed. Conversely, while no support sheet is disposed between the rolls, support roll 26 is maintained separated from heat roll 25 by the pivot levers as shown in FIG. 1. Of course, while support sheet 20 is transferred in the direction of arrow B while being pressed together between the rolls, the toner is fused under heat so that the toner image is fixed to the support sheet as shown in FIG. 3.

Figure 2:
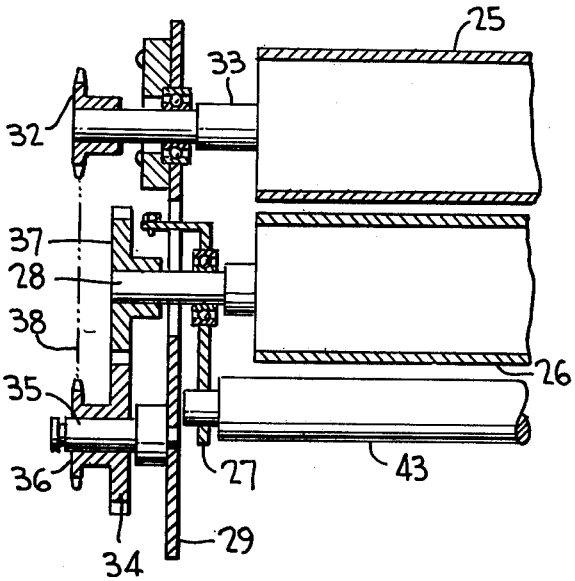
FIG. 2 is a cross-sectional view, partly broken away, taken substantially along line 2—2 of FIG. 1.

In FIGS. 1 and 2, feed roll 25 and support roll 26 are shown slightly spaced apart, the heat roll being rotatable at a constant speed by means of a chain sprocket 32 mounted at one end of axial shaft 33 of the heat roll. A gear wheel 34 is rotatably mounted on frame member 29 by means of its shaft 35, a sprocket wheel 36 being integrally connected with gear wheel 34 as shown in FIG. 2. A gear wheel 37 is mounted at one end of shaft 28 of the support roll and is disposed in meshing engagement with the gear teeth of gear 34. A sprocket chain 38 extends about sprocket gears 32, 36 and 24, and is moved by a suitable power source, such as a gear motor (not shown), so as to effect rotation of sprocket wheels 32 and 36 at a constant speed. Conveyor wheel 23 is likewise rotated at the same speed as is gear wheel 37 which is in meshing engagement with gear wheel 34. Accordingly, support roll 26, while in its first position shown in FIGS. 1 and 2 as separated from heat roll 25, is rotated at the same speed as heat roll 25.

Figure 3:
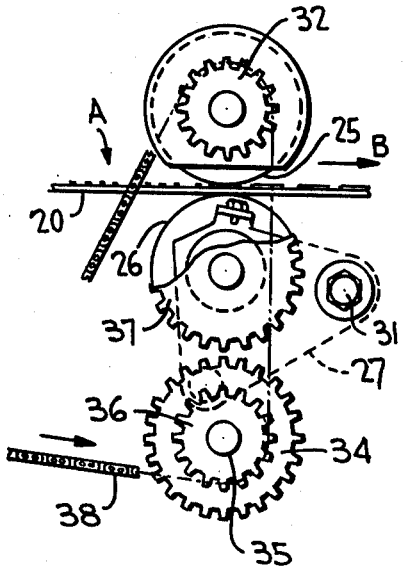
FIG. 3 is a view similar to FIG. 1 showing the position of the rolls during the fusing operation of the apparatus.

When the leading edge of support sheet 20 reaches a position just in front of rolls 25 and 26, levers 27 are pivoted upwardly about their shafts 31 thereby moving support roll 26 toward roll 25 whereupon the teeth of gear wheels 37 and 34 become disengaged as shown in FIG. 3. The space between rolls 25 and 26 for the first position of the support roll shown in FIG. 2 is greater than the depth of the intermeshing gear teeth so as to permit the gear teeth so as to permit the gear teeth disengagement shown in FIG. 3 wherein the support roll is moved into its second position of cooperating pressure contact with the heat roll. Thus, the support roll is no longer rotated by sprocket chain 38, but is instead rotated while in frictional contact with the under surface of the support sheet. Support sheet 20 is therefore pressed between rolls 25 and 26 and toner image A is fused thereon while the support sheet is transferred in the direction of arrow B.

When the trailing edge of the support sheet has passed through rolls 25 and 26, levers 27 are downwardly pivoted thereby separating support roll 26 from heat roll 25 so as to reset the support roll to its first position whereby gear wheels 34 and 37 are again brought into meshing engagement whereupon support roll 26 is again rotated by the driving mechanism associated therewith.

Friction wheels or the like may be used in lieu of gear wheels 34 and 37, and sprocket chain 38 may be substituted for a different type chain, timing belt, V-or gear belt. Alternatively, the fusing apparatus may be so designed for support roll 26 to be driven in a fixed position while heat roll 25 is shifted between first and second positions similarly as in the manner aforedescribed for the support roll.

The mechanism for shifting support roll 26 between its first and second positions is shown by way of example in FIGS. 4 to 10. A cam follower 39 is fixedly mounted on a connecting rod 41 which is rigidly mounted at its opposite ends to levers 27 as shown in FIG. 5. The cam follower is in sliding engagement with a cam element 42 which is fixedly mounted on a shaft 43. This shaft is rotatably mounted on frame members 29, and has a sprocket wheel 44 and a clutch 45 mounted at one end thereof. A sprocket chain 46, illustrated in phantom outline in FIG. 5, engages with the teeth of wheel 44 as well as with the teeth of a motor sprocket (not shown) which is the same power source provided for driving sprocket chain 38.

Figure 6:
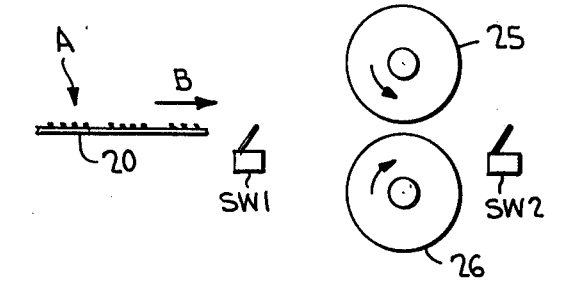
FIG. 6 is a side elevational view illustrating the location of sheet detecting switches relative to the rolls of FIG. 1.

Actuation of clutch 45 is controlled by microswitches SW1 and SW2 which are respectively located on the machine ahead of and behind rolls 25 and 26, in the direction of sheet travel, as shown in FIG. 6. The microswitches have movable contacts of a known construction capable of being switched over from one side to the other by the advancing movement of support sheet 20. Clutch 45, as described in the drawings, may be a half-turn type clutch which is interconnected with a solenoid 47 which is controlled by the switching operation of microswitches SW1 and SW2. An electromagnetic clutch may be alternatively used, such clutch being directly controlled by the actuation of the microswitches.

Figure 7:
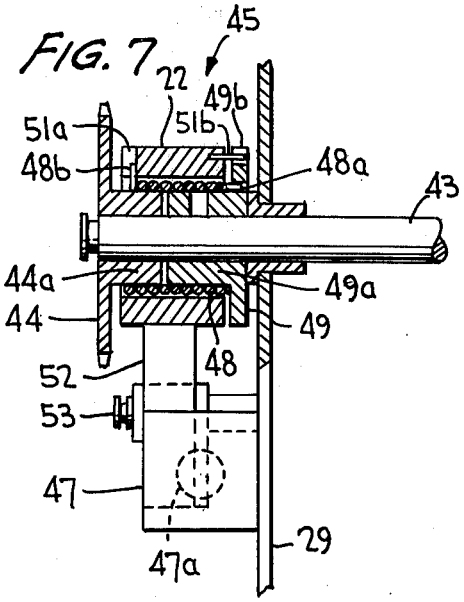
FIGS. 7 and 8 respectively longitudinal- and cross-sectional views of a clutch mechanism for the fusing apparatus in accordance with the one embodiment of the invention.
Figure 8:
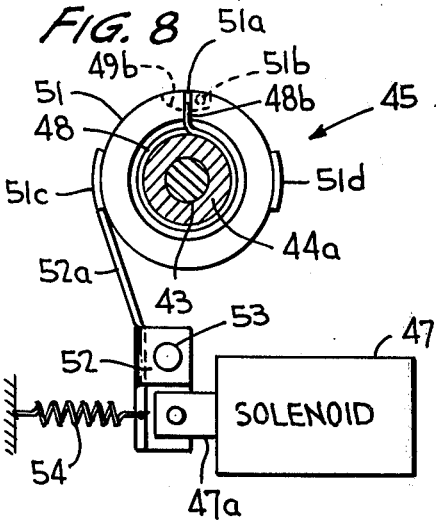

Clutch 45, as detailed in FIGS. 7 and 8, includes a coil spring 48 disposed about the outer periphery of a flank portion 44*a* of sprocket 44 which is rotatably mounted on shaft 43. Spring 48 is likewise disposed about the outer periphery of a flank portion 49*a* of a flanged sleeve 49 which is fixedly mounted on shaft 43 for rotation therewith. Also, the spring is fixedly attached at one end 48*a* thereof to sleeve 49. A cam element 51 is loosely disposed about coil spring 48 and has an opening 51*a* with which the other end 48*b* of the spring engages. A pin 51*b* projecting from cam element 51 engages a slightly elongated opening 49*b* provided on a peripheral flange of sleeve 49. Accordingly, cam element 51 is capable of slightly rotating relative to sleeve 49 within a predetermined rotational angle. Also, the cam element has first and second projections 51*c* and 51*d* which extend outwardly of the outer periphery thereof on a diametrical line of the cam element.

An actuating plunger 47*a* of the solenoid is connected at its outer end to a base portion of a trigger lever 52 which is pivotally mounted on a shaft 53. Lever 52 is spring biased by a spring 54 for pivotal movement about is shaft 53 in a clockwise direction as viewed in FIG. 8. One end of spring 54 is connected to lever 52 and the other end thereof is fixed on a portion of the machine. Accordingly, trigger lever 52 is urged by the action of spring 54 so as to bring its free end 52*a* into sliding contact with the peripheral surface of cam element 51 and in abutting engagement with either of projections 51*c* or 51*d* when the solenoid is not actuated, as shown in FIG. 8.

The coil turns of spring 48 are so arranged as to tightly embrace the peripheral surface of flank portions 44*a* and 49*a* as sprocket 44 rotates counterclockwise as viewed in FIG. 8. Accordingly, sleeve 49 will be made to rotate together with sprocket 44. And, since cam element 51 is connected to the sleeve by means of its pin 51*b*, the cam element is rotated together with sleeve 49. Therefore, when rotation of the cam element is interrupted as the trigger lever end 52*a* engages with one of the cam projections, the spring loosens its engagement with flank portions 44*a* and 49*a* since end 48*b* of the coil spring is connected to the cam element. Accordingly, sprocket 44 is permitted to idly rotated. In other words, the clutch is operated through rotation of cam element 51 or through the interruption of this rotation. The clutch acts as a half-turn type clutch by reason of projections 51*c* and 51*d* which are spaced apart by an angle of 180° on the circumference of the cam element. And, the solenoid is controlled through an electric circuit shown in FIG. 9.

Figure 9:
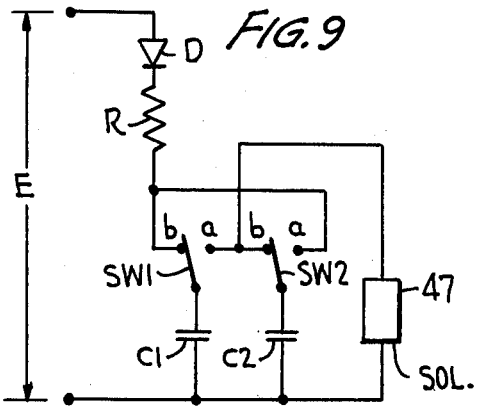
FIG. 9 is a diagram of an electric circuit for the fusing apparatus of FIG. 1.

Referring to FIG. 6 wherein support sheet 20 is shown being tranferred toward the rolls of the fusing apparatus, the leading edge of the sheet pushes against the actuating element of microswitch SW1 so that this switch is moved from its contact *b* to its contact *a* shown in FIG. 9, whereby an electric charge stored in capacitor C1 is applied to a capacitor C2 as well as to the solenoid. Thus, solenoid 47 is energized to rotate trigger lever 52 in a counterclockwise direction, as plunger 47*a* of the solenoid retracts. First cam projection 51*c* therefore disengages from the free end 52*a* of lever 52 so as to permit rotation of cam element 51. Therefore, clutch 45 engages by the action of spring 54 as aforedescribed so that shaft 43 is caused to rotate thereby rotating cam element 51. Support roll 26 is therefore shifted from its first position of FIG. 2 to its second position of FIG. 3 as rotating cam element 42 slides against cam follower 39 so as to pivot the support roll upwardly by means of levers 27.

The discharging durations of capacitors C1 and C2 are set to extremely short time periods. And, as stated above, projections 51*c* and 51*d* are diametrically opposed so as to be spaced 180° apart. Accordingly, solenoid 47 becomes de-energized immediately after the engagement of trigger lever 52 with cam projection 51*c* has been released and, consequently end 52*a* of the trigger lever is brought into sliding engagement with the peripheral surface of cam elements 51 by the action of spring 54.

Figure 4:
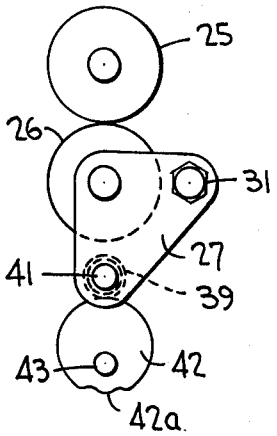

Upon rotation of cam element 51 through an angle of 180°, second cam projection 51*d* is engaged by end 52*a* of the trigger lever to thereby interrupt the rotation of cam element 51. Thus, spring 48 loosens its embrace with sprocket 44 and sleeve 49 thereby permitting sprocket 44 to idly rotate whereby cam element 42 is stopped after its rotation through an angle of 180°. The contacting heat and support rolls and the associated driving mechanism are disposed as shown in FIGS. 4 and 5.

As the support sheet continues its travel between rolls 25 and 26 of the fusing apparatus which fixes the toner image thereon, the leading edge of the sheet pushes against the actuating element of microswitch SW2 so that such element is moved from a contact *b* to a contact *a* of this microswitch whereby electricity is charged, via a diode D and a resistor R, to the capacitor C2 while the solenoid remain unexcited. When the trailing edge of support sheet 20 has moved beyond microswitch SW1, the contact element of such switch is moved from its contact *a* back to its contact *b* whereby electricity is charged to capacitor C1 while the solenoid remains unexcited. After fusing of the toner image onto the support sheet is completed, and when the trailing edge of the support sheet has moved beyond microswitch SW2, the contact of that switch is moved from its contact *a* back to its contact *b.* Thus, the electric charge in capacitor C2 is impressed on the solenoid thereby instantaneously exciting the solenoid so as to retract its plunger 47*a* whereby the engagement between cam projection 51*d* and trigger lever 52 is released. Thus, clutch 45 is engaged whereby cam element 42 is rotated through 180° thereby rotating levers 27 in a counterclockwise direction as viewed in FIG. 4. Consequently, support roll 26 is shifted from its second position back to its first position and is maintained out of contact with heat roll 25.

Through the half-cycle of rotation of cam element 42, cam projection 50*c* engages end 52*a* of the trigger lever whereby the rotation of cam element 51 is interrupted, such that cam follower 39 is maintained in contact with a portion 42*a* of cam element 42 until the leading edge of the support sheet actuates microswitch SW2. During such time support roll 26 is rotated as aforedescribed by means of interengaged gears 37 and 34 as they are rotated by the rotation of sprocket 36.

Figure 10:
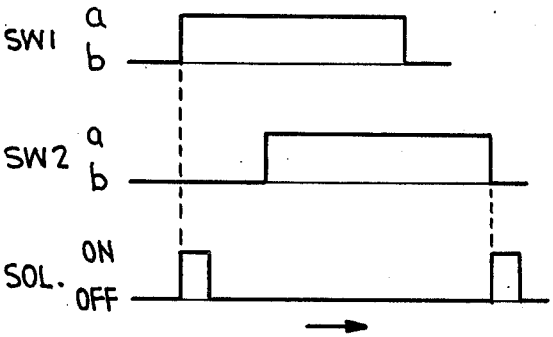
FIG. 10 is a time chart showing the operational sequence of the fusing apparatus of FIG. 1.

FIG. 10 is a block diagram showing the operation of microswitches SW1 and SW2 and the solenoid in the electric circuit of FIG. 9.

In order to control the operational timing of cam element 42, a cam, a combination of a cam and a microswitch, or a timer may be used in as much as such means may detect support sheet 20 which passes through between the heat and support rolls. Or, such means may control either the heat roll or the support roll in timing synchronism with the travelling of sheet 20.

In accordance with the first embodiment described with reference to FIGS. 1 to 10 of the drawings, it can be seen that the heat roll and support roll are maintained in pressure-contacting relation to one another for a time duration during which the support sheet is present between the rolls. On the other hand, both rolls are maintained spaced apart from one another for a time duration during which the support sheet is not present between the rolls. Such a function contributes greatly to an increase in the durability of the heat and support rolls. Furthermore, both rolls are rotated during the operation of the copying machine even while both rolls are separated from one another thereby avoiding the risk of the rolls from being locally overheated. Moreover, while both rolls are maintained in pressure-contacting relation to one another, they are rotated at the same circumferential speed as rotation of the heat roll is transmitted to support roll through movement of the support sheet therebetween, the support roll idly rotating during this toner image fusing mode of the apparatus. And, the roll driving mechanism is of simple construction as compared to prior art, and avoids any defective gear meshing engagement as often occurs with other roll driving mechanisms.

Figure 11:
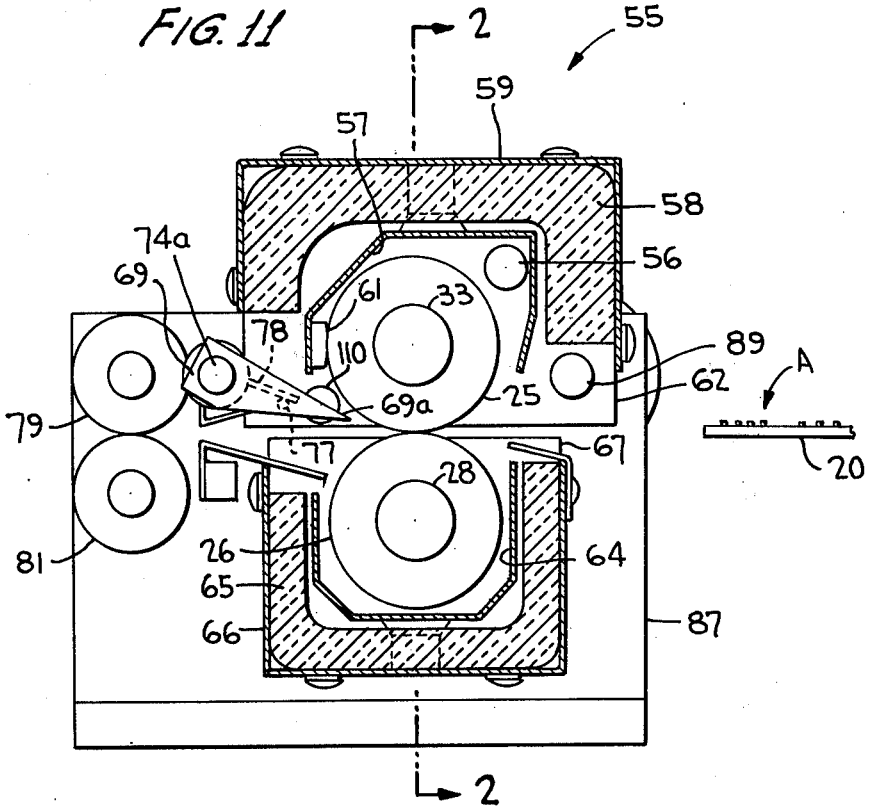
FIG. 11 is a side elevational view, partly in section, of a fusing apparatus showing the details thereof in accordance with another embodiment of the invention.

In accordance with another embodiment of the invention shown in FIGS. 11 to 15, similar elements between the two embodiments are identified by the same reference numerals. In FIG. 11, support sheet 20 having toner image A thereon, is fed in the direction of arrow B into a fusing apparatus 55 by transfer means similar to that shown in FIG. 1. The support sheet is fed toward the nip of heat roll 25 and support roll 26 which are identical to the heat and support rolls described with reference to the first embodiment. The heat and support rolls are normally maintained in light contact with one another, under the weight of the heat roll so that the heat roll can be rotated by the driving support roll. Thus, for a duration in which support sheet 20 passes between the rolls and is therebetween, the pressure necessary for fusing the toner image on the support sheet acts on both rolls while the pressure is maintained at a constant level.

Heat roll 25 is heated to a predetermined temperature by a heat source 56 provided externally thereof. In order to enhance the heating efficiency and to reduce the time for commencing a copying operation, the volume of the air surrounding the heat roll is minimized for apparatus 55. Accordingly, heat roll 25 is partially surrounded by a reflecting plate 57 having good heat capability as well as good heat conductivity. Such a plate may be of aluminum which has been subjected to an electrolytic polishing, a nickel-plate, copper plate or the like, so that radiant heat from the heat source may be efficiently applied to the peripheral surface of the heat roll. As a result, the air in the space defined by plate 57 and the heat roll is rapidly heated since the reflecting plate will itself serve as a heat source. In order to avoid undue cooling of plate 57, it is covered with a heat-insulating material 50 such as glass wool, microtherm, mineral wool or the like, and such material is shielded by a cover 59.

The surface temperature of heat roll 25 is controlled for a predetermined temperature by means of a temperature detecting element 61 such as a thermostat attached to plate 57 and operatively connected to the heat source for varying the amount of elelctric power to be supplied from the heat source to the heat roll.

Cover 59 is secured to upper frames 62 and 63 made of heat-insulating material such as ceramic, Teflon or the like. Heat roll 25 is rotatably mounted at its opposite ends to these frames which are so designed to minimize the loss of heat from the heat roll so that the surface temperature thereof can be maintained constant. Also, the upper frames are so constructed as to permit the heat roll to be rotatably driven directly by the support roll.

A reflecting plate 64 partially surrounds support roll 26 for purposes similar to that described for the heat roll reflecting plate. Plate 64 is covered with a heat-insulating material 65 which is shielded by a cover 66 attached to lower frames 67 and 68. These lower frames are likewise made of heat-insulating material for preventing the loss of heat from opposite ends of the support roll. The support roll is mounted for rotation on the lower frames by means of its shaft 28, and is rotated by a driving mechanism to be hereinafter fully described.

Since the support roll and heat roll are normally maintained in light contact with one another and are both coated with heat-insulating material, the support roll will not be heated to a temperature as high as that of the heat roll due to the resistance to heat transmission when the rolls are in contact.

Accordingly, the thickness of material 65 can be made less than the thickness of material 58. Also, because of the normally rising heated air due to natural convection, heat-insulating material 58 should be preferably thicker so that material 58 serves as a housing for the support roll and its insulating material as shown in FIG. 11. With such an arrangement the energy consumption of heat source 56 may be reduced with the result that the fusing apparatus requires less energy for operation.

Should heat roll 25 become overheated, support sheet 20 tends to adhere thereto due to the multi-adhesive force of toner image A. Accordingly, a stripping pawl 69 is provided as shown in FIG. 11. This pawl is so arranged that its pointed end 69*a* is moved into contact with the peripheral surface of the heat roll at the time the leading edge of the support sheet is moved between rolls 25 and 26. The support sheet may therefore be stripped from the surface of the heat roll after which the pawl is returned to its initial position spaced from the heat roll as shown in FIG. 11.

Figure 14:
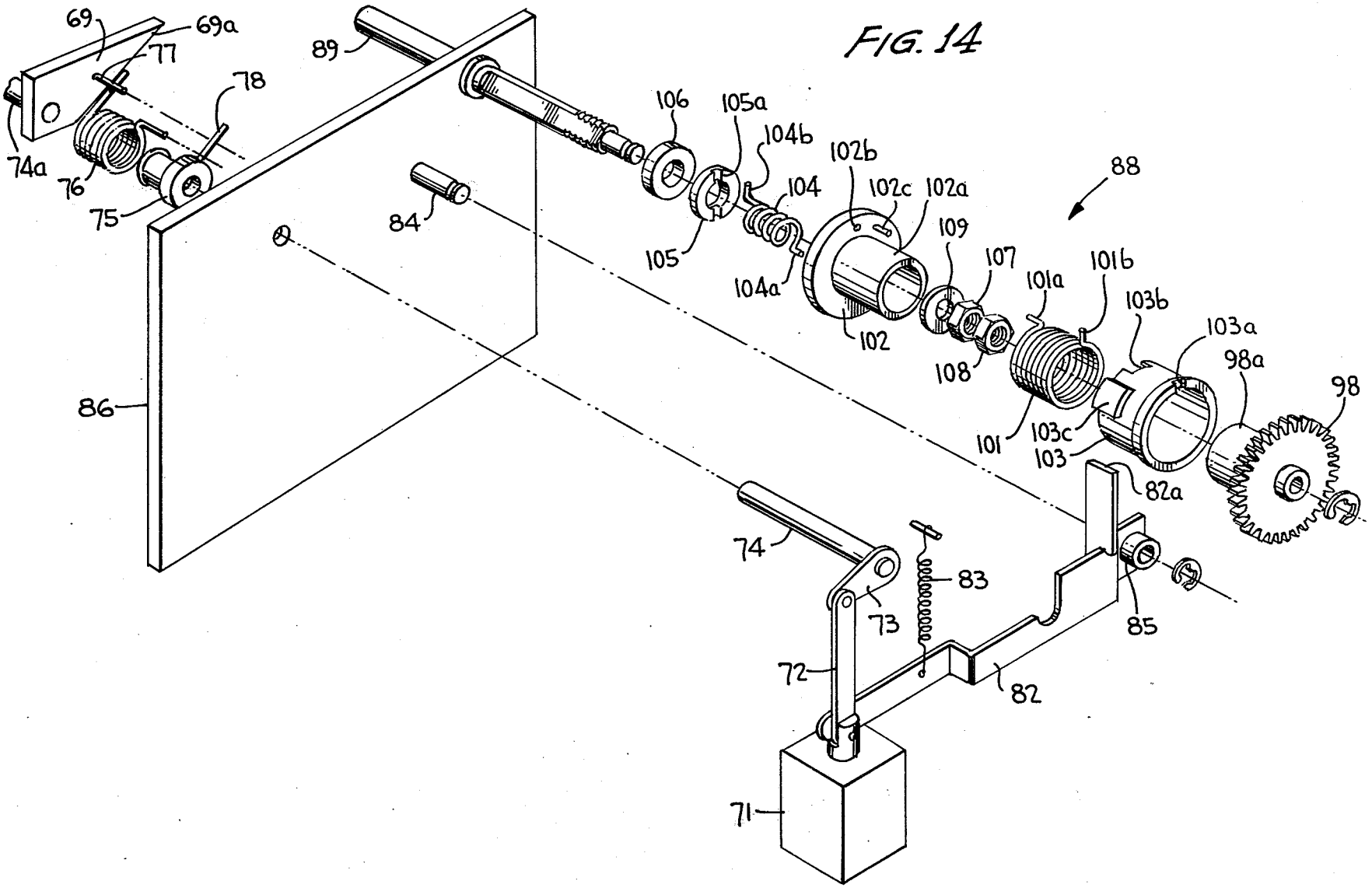
FIG. 14 is an expanded perspective view of a pressing mechanism for the fusing apparatus of FIG. 11.
Figure 13:
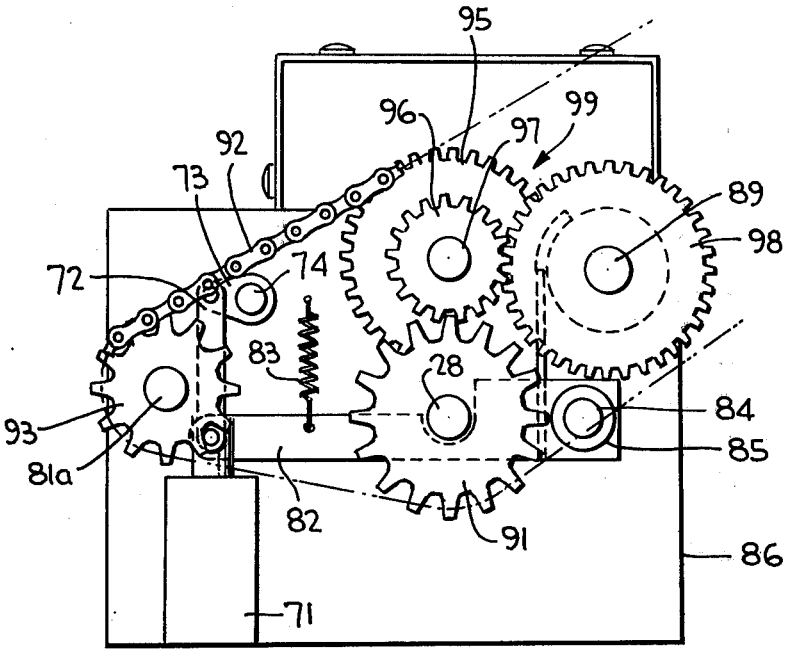
FIG. 13 is a side elevational view of a driving mechanism for the fusing apparatus of FIG. 11.

A microswitch similar to SW1 shown in FIG. 6 may be provided in the travelling path of support sheet 20 so that, as the leading edge of the support sheet strikes a contact element of the microswitch, solenoid 71 as shown in FIGS. 13 and 14, is actuated. Such actuation serves to retract solenoid plunger 72 thereby causing a counterclockwise rotation (when viewed in FIGS. 13 and 14) of a lever 73 pivotally mounted at the end of the plunger. Lever 73 is fixedly mounted on a shaft 74 on which a sleeve 75 is fixed so that the sleeve is likewise rotated counterclockwise.

Pawl 69 is rotatably mounted on shaft 74 or on a shaft 74*a,* and is urged for movement in a counterclockwise direction by a spring 76 which surrounds the shank of flanged sleeve 75. However, the counterclockwise rotation of stripping pawl 69 is impeded as pin 77 on the pawl engages one end of the spring, and a pin 78 on sleeve 75 engages the opposite end of spring 76. The pawl is therefore normally maintained in its position shown in FIG. 11. When sleeve 75 is rotated counterclockwise, pawl 69 is rotated in the same direction by the action of spring 76 so that end 69*a* of the pawl is moved into sliding contact with the peripheral surface of heat roll 25. Accordingly, the support sheet will be conveniently stripped from the heat roll if it tends to adhere thereto during the fusing operation.

The duration of actuation or excitation of the solenoid is set for a short period of time required for stripping the support sheet from the heat roll. Following such time, lever 73, shaft 74, sleeve 75 and pawl 69 are all returned to their initial positions so that pawl 69, as shown in FIG. 11, serves to guide the support sheet thus separated toward delivery rolls 79 and 81.

When solenoid plunger 72 is retracted into the solenoid upon actuation thereof, an operating lever 82 is also rotated counterclockwise against the force of a spring 83. This operating lever is mounted for pivotal movement about a shaft 84 and is pivotally mounted on such shaft by means of its bushing 85. Shaft 84 is fixedly mounted on a frame member 86 of the copying machine, a frame member 87 of the machine being spaced therefrom.

Figure 15:
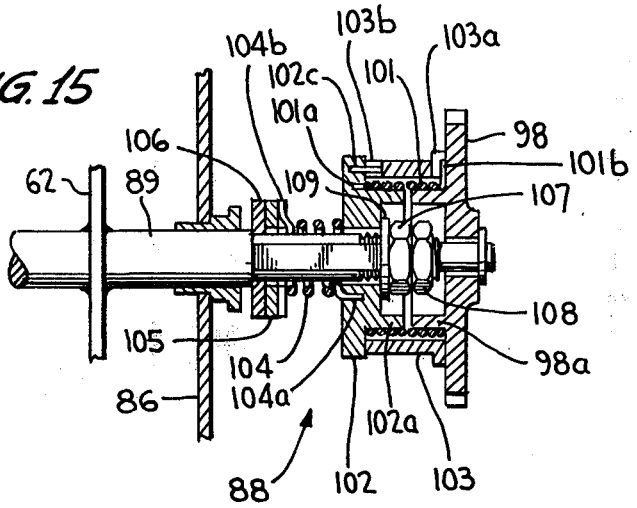
FIG. 15 is a sectional view taken through the pressing mechanism of FIG. 14.

Pivotal movement of operating lever 82 serves to operate a pressing mechanism 88 provided for the fusing apparatus. Such mechanism comprises a combination of a single turn clutch and a sliding friction mechanism which are both mounted as shown in FIGS. 14 and 15 on a support shaft 89 rigidly mounted on frames 86 and 87 of the machine.

Figure 12:
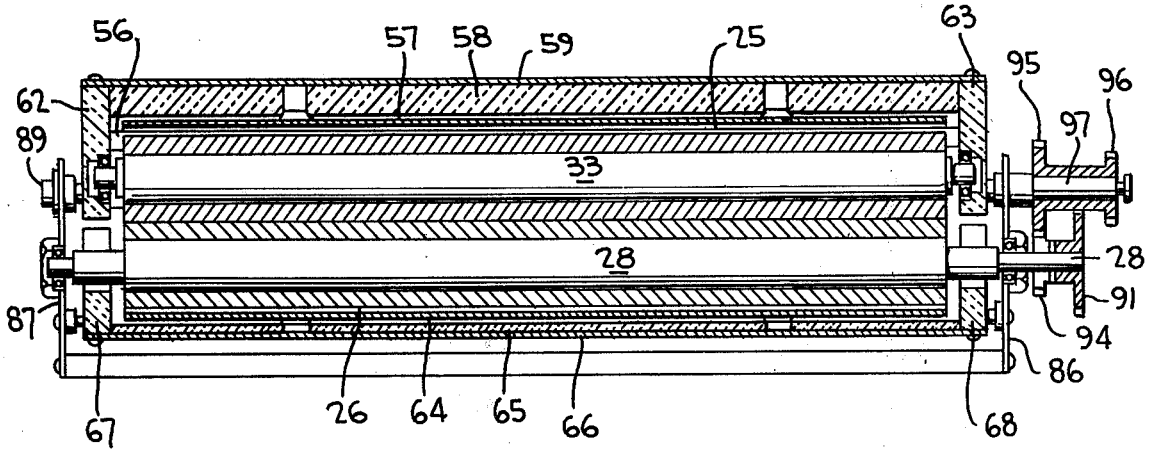
FIG. 12 is a sectional view taken substantially along line 12—12 of FIG. 11.

Upper frames 62 and 63 are fixedly mounted on shaft 89, for movement together therewith about the shaft axis, in such a manner that heat roll 25 is normally maintained in light contact with support roll 26 by its own weight. A sprocket wheel 91, fixedly mounted at one end of shaft 28 of the support roll as shown in FIGS. 12 and 13, is rotated at a predetermined speed by means of a sprocket chain 92 engaged therewith. Thus, the contacting heat roll is driven upon rotation of the support roll. Although only the surface temperature of the heat roll is controlled at the described temperature range, the difference in surface temperature between the heat roll and the support roll is quite small because of the constant contact therebetween. Any sharp drop of the surface temperature of the heat roll while the support sheet is passing between the rolls, is therefore prevented and the offset phenomenon due to low temperature transfer is accordingly avoided.

Sprocket chain 92 engages the teeth of a sprocket wheel 93 fixedly mounted on shaft 81*a* of the lower delivery roll 81 for rotation of same. The hold-down delivery roll 79, in contact with roll 81 and being mounted for free rotation, is rotatably driven by roll 81. Support sheet 20 passes between the nip of these delivery rolls upon completion of the fusing operation so as to be delivered to the exterior of the copying machine. And, by rotating delivery rolls 79 and 81 at a slightly higher speed than that of rolls 25 and 26, support sheet 20 may be transferred at a desired tension outwardly of the machine, so that any jamming of the support sheet at the fusing station is substantially avoided.

A reduction gear wheel 94 is fixedly mounted on shaft 28 of the support roll as shown in FIG. 12, the teeth of gear 94 meshing with the teeth of a double gear wheel 95 which also has a reduced gear wheel 96 thereon. This double gear is mounted on a shaft 97, and the teeth of gear 96 are in meshing engagement with the teeth of a gear wheel 98 which is rotatably mounted on support shaft 89 as shown in FIG. 13. These gears comprise a reduction gear mechanism 99, and the reduction ratio of the gears is set to such a value that support sheet 20 may pass through the heat and support rolls during one cycle of rotation of gear 98.

A single turn clutch mechanism, in which a coil spring 101 is used, is associated with gear 98. Such spring surrounds a flank portion 98*a* of gear 98 as well as a flank portion 102*a* of a flanged sleeve 102, which faces gear 98 as shown in FIG. 15. The spring engages an opening 102*b* of the sleeve at one end 101*a* thereof, and engages a cut-out portion 103*a* of a cam member 103 at the other end 101*b* thereof. The cam member itself surrounds the spring. The coils of spring 101 are would in such a direction as to become tightened upon counterclockwise movement between is ends, when viewed in FIG. 14. Gear 98 is rotated counterclockwise by the drive mechanism shown in FIG. 13 and, during the time cam member 103 is free to rotate (in a manner to be hereinafter described), spring 101 tightly embraces flank portions 98*a* and 102*a* of the gear and sleeve so that sleeve 102 is rotated together with the gear. When rotation of the cam member is interrupted, as to be described later, the coils of spring 101 loosen their grip on the gear and sleeve shank portions, thereby allowing idle rotation of gear 98. Sleeve 102 is rotatably mounted on shaft 89, and the sleeve and cam member are interengaged as pin 102*c* extends into cut-out portion 103*b* so that the sleeve and cam member may be relatively shifted in the rotational direction within the range defined by cut-out portion 103*b* and pin 102*c.*

Similarly as in the first embodiment, a projection 103*c* is provided on the outer periphery of the cam member except that, in this second embodiment, only one of such projections is provided. This projection is designed to effect an interruption of cam member rotaton as the projection engages portion 82*a* of operating lever 82. It will be seen that such engagement takes place while solenoid 71 remains inoperative so as to thereby impede rotation of cam member 103 in a counterclockwise direction. When the solenoid is excited, engagement between portion 82*a* and projection 103*a* is released to thereby allow the cam member to rotate counterclockwise. As shown as such engagement is released, the coils of spring 101 are tightened about shank portions 98*a* and 102*a* thereby effecting an engagement of the clutch whereby sleeve 102 is caused to rotate together with gear 98. Solenoid 71 is so designed as to actuate for an extremely short period of time, i.e. instantaneously. Thus, operating lever 82 is returned to its initial position by the action of spring 83 when cam projection 103*c* moves beyond portion 82*a* whereby such portion comes into sliding contact with the peripheral surface of cam member 103 until it is again brought into engagement with the cam projection after one complete cycle of rotation of the cam member. While rotation of the cam member is interrupted by reason of the engagement between the cam projection and portion 82*a,* the clutch is disengaged so as to permit gear 98 to idly rotate. It can be therefore seen that the clutch acts as a single turn clutch.

The duration of actuation of the solenoid is set for a period of time necessary to effect stripping of support sheet 20 from heat roll 25 by means of stipping pawl 69 as aforedescribed. Such duration of solenoid actuation is controlled by suitably setting the time limit during which cam projection 103*c* returns to engagement with upright portion 82*a* of the operating lever. More particularly, the circumferential length of cam projection 103*c* is set at a desired length to thereby affect the remaining length of the cam member peripheral surface which is available for sliding contact by portion 82*a.* The restoring operation of solenoid 71 is therefore interrupted. In such manner, the exciting duration of the solenoid, during which cam projection 103*c* is disengaged from portion 82*a,* may be instantaneous.

Even when the solenoid is instantaneously de-energized, tip 69*a* of the stripping pawl is maintained in sliding contact with the peripheral surface of the heat roll for the duration in which projection 103*c* is moving relative to upright portion 82*a.* An electric timer or other mechanical means for directly controlling the solenoid may therefore provide the desired timer function.

Sleeve 102 is connected by means of a coil spring 104 to a friction ring 105 which is rotatably mounted on shaft 89 and is urged toward a force receiving ring 106 under the force of spring 104, such force receiving ring being fixedly mounted on shaft 89. Spring 104 is fixedly secured at one end 140*a* to sleeve 102, its other end 104*b* being in engagement with a diametrically extending groove 105*a* of the friction ring. Sleeve 102 and friction ring 105 are therefore coupled together in a rotating direction. Moreover, sleeve 102 is urged toward rings 105 and 106 by means of lock nuts 107 and 108 which are threaded onto a portion of shaft 89. A washer 109 may likewise be provided.

The rotational force of sleeve 102 is transmitted to shaft 89 to effect rotation thereof. Such transfer of the rotational force is effected by spring 104 and rings 105, 106. The heat roll is thereby urged toward the support roll so as to exert an amount of pressure on the support sheet necessary for fixing the toner image formed thereon. As soon as support sheet 20 is passed through the heat and support rolls, the clutch of the pressing mechanism becomes disengaged so that the aforesaid pressure acting on both rolls is released. Naturally such pressure can be adjusted to a desired level by adjusting the friction transmitting force, i.e., the frictional engagement between rings 105 and 106 may be varied by means of the rightening or loosening of the lock nuts on shaft 89. During the time when no support sheet is located between the heat and support rolls, the rolls are maintained in light contact with one another under the weight of the heat roll. This prevents the formation of any dents on the roll surfaces and any warping of the rolls. Moreover, the surfaces of the rolls are maintained at the necessary temperature for the fixing of the toner image during operation of the copying machine.

The toner image support sheet which has passed rolls 25 and 26 is delivered to the exterior of the machine under a desired tension by the action of deliverly rolls 79 and 81. Any disturbance of the image thus fixed on the support sheet is avoided by reason of the tension provided by the delivery rolls, so that support sheet 20 slidingly contacts the stripping pawl. Also, an idler roll 110 is disposed adjacent the stripping pawl for preventing jamming of the support sheet as it moves through the heat and support rolls, and for assuring a smooth delivery of the sheet.

In the FIG. 11 embodiment, the heat roll used is of an externally heated type although an internally heated roll may be instead used, or use of a combination type roll is possible which is heated both internally and externally. Also, other mechanical or electrical means capable of controlling the duration of pressure application may be used in lieu of the single turn clutch and the sliding friction clutch, without departing from the scope of the present invention.

From the foregoing it can be seen that the heat-insulating characteristics of the housings for the heat and support rolls are greatly improved to thereby effect a lower energy consumption of the copying machine. The reflecting plates are disposed as nearly as possible to the heat and support rolls so as to minimize the volume of the air surrounding the rolls, with the result that the rolls are heated up quickly and the heating efficiency thereof is enhanced. Furthermore, the heating area from the heat source is made more uniform thereby assuring the provision of a more uniform surface temperature for the roll, and apparatus 55 is compact with an accompanying reduction in the heat dissipating area thereof.

The force urging the heat and support rolls together is controlled by a pressing mechanism which permits the rolls to be normally maintained in light pressure contact with one another, while no support sheet is moving therebetween. This contributes to increasing the durability of the rolls, as well reducing the heat dissipation to the support roll due to the resistance to heat transmission when in contacting with the heat roll. And, abrupt temperature drop of the heat roll is likewise prevented, which temperature drop would otherwise arise when pressing the support sheet, with the result that an offset phenomenon which tends to occur during low and high temperature transfers, is completely avoided.

The stripping pawl is provided for safety purposes and serves to prevent adhesion of the support sheet to the heat roll that the support sheet will not be overheated and hence not burned. The duration at which the stripping pawl is maintained in contact with the heat roll is extremely short so as to therefore avoid any overheating of the stripping pawl. Also, the period of time in which the solenoid is extremely short thereby permitting the use of a small solenoid which will of course reduce the power consumption of the copying machine.

Obviously, many other modifications and variation of the invention are made possible in the light of the above teachings. It is therefore to be understood that within the scope of the appended claims the invention may be practiced otherwise than as specifically described.

What is claimed is:

1. A heat roll assembly for an electrophotographic copying machine, comprising: frame means;

a pair of rolls comprising a heat roll and a support roll between which a support sheet bearing a toner powder image may pass;

one of said rolls being rotatably mounted on said frame means;

a roller assembly including levers pivotally mounted on said frame means, the other of said rolls being rotatably mounted on said levers for pivotal movement therewith, said roller assembly being pivotally mounted on said frame means for movement between a first position of rotative contact between said rolls and a second position wherein said rolls are spaced apart;

drive means for driving both of said rolls;

shift means including a shaft rotatably mounted on said frame means, said shaft having a cam element thereon in sliding contact with a cam follower mounted on said levers, a sprocket wheel rotatably mounted on said shaft and being in engagement with said drive means, and clutch means on said shaft for coupling the rotation of said sprocket wheel to said shaft for rotation thereof so as to effect movement of said roller assembly between said first and second positions;

means detecting arrival and departure of the support sheet from said rolls;

said shift means being actuated by said detecting means upon the arrival of the support sheet for shifting said other roll from said second to said first positions for rotation by said first roll, and for shifting said other roll to said second position from said first position upon the departure of the support sheet; and said drive means being operatively connected to both said rolls for rotating said other roll only while in said second position.

2. The assembly according to claim 1, wherein said drive means include gear means on said other roll which gear means become disengaged upon movement of said other roll into said first position.

3. A fusing apparatus for an electrophotographic copying machine, comprising:

frame means;

a pair of rolls comprising a heat roll and a support roll between which a support sheet bearing a toner powder image may pass;

a heat source for heating said heat roll to a level suitable for fusing the toner image on the support sheet;

one of said rolls being rotatably mounted on said frame means;

a roller assembly including levers pivotally mounted on said frame means, the other of said rolls being rotatably mounted on said levers for pivotal movement therewith, said roller assembly being pivotally mounted on said frame means for movement between a first position of rotative contact between said rolls and a second position wherein said rolls are spaced apart;

drive means for driving both said rolls;

shift means including a shaft rotatably mounted on said frame means, said shaft having a cam element thereon in sliding contact with a cam follower mounted on said levers, a sprocket wheel rotatably mounted on said shaft and being in engagement with said drive means, and clutch means on said shaft for coupling the rotation of said sprocket wheel to said shaft for rotation thereof so as to effect movement of said roller assembly between said first and second positions;

means detecting arrival and departure of the support sheet from said rolls;

said shift means being actuated by said detecting means upon the arrival of the support sheet for shifting said other roll from said second to said first positions for rotation by said first roll, and for shifting said other roll to said second position from said first position upon the departure of the support sheet; and said drive means, when said other roll is in said first position, being adapted to drive said one roll so that said other roll is idly rotated by said one roll, and being adapted to drive both said rolls when said other roll is in said second position.

4. The apparatus according to claim 3, wherein said drive means include gear means on said other roll which gear means become disengaged upon movement of said other roll into said first position.

* * * * *